US005294151A

United States Patent [19]

Goode

[11] Patent Number: 5,294,151

[45] Date of Patent: * Mar. 15, 1994

[54] COMPOSITE SKI POLE

[76] Inventor: David P. Goode, 1997 Long Lake Shores Dr., Bloomfield Hills, Mich. 48013

[ * ] Notice: The portion of the term of this patent subsequent to Jun. 18, 2008 has been disclaimed.

[21] Appl. No.: 863,334

[22] Filed: Apr. 2, 1992

Related U.S. Application Data

[63] Continuation of Ser. No. 448,306, Dec. 11, 1989, abandoned.

[51] Int. Cl.[5] ..... A63C 11/22

[52] U.S. Cl. ..... 280/819; 428/68; 428/70

[58] Field of Search ..... 280/819; 428/68, 70

[56] References Cited

U.S. PATENT DOCUMENTS

| | | | |
|---|---|---|---|
| 2,123,311 | 7/1938 | Müller-Roggli | 280/819 |
| 2,573,361 | 10/1951 | Rogers, Jr. et al. | 64/2 |
| 3,265,401 | 8/1966 | Speier | 280/819 |
| 4,301,201 | 11/1981 | Stout | 280/819 |
| 4,948,647 | 8/1990 | Burkard | 428/70 |
| 5,024,866 | 6/1991 | Goode | 280/819 |

FOREIGN PATENT DOCUMENTS

| | | | |
|---|---|---|---|
| 18-17827 | 7/1943 | Japan | 280/819 |
| 1-135380 | 5/1989 | Japan | 280/819 |
| 242862 | 11/1946 | Switzerland | 280/819 |

*Primary Examiner*—Eric D. Culbreth
*Attorney, Agent, or Firm*—Krass & Young

[57] ABSTRACT

A lightweight, flexible ski pole which is virtually indestructible comprises a filament-reinforced, resin-matrix composite shaft having a diameter of about 0.05 in or less and a tensile strength of about 140,000 or higher. The shaft may be severely bent without damage or deformation. A surface coating of acrylic paint is applied by dip coating. A metal tip is adhesively applied, as are hand grip and basket. The shaft may be solid or hollow, straight or tapered near the lower end. If hollow and tapered, the tapered end is reinforced with a short reinforcing rod.

13 Claims, 2 Drawing Sheets

CUTTING APPARATUS
THERMO-SETTING DIE
VEILING STATION
RESIN BATH

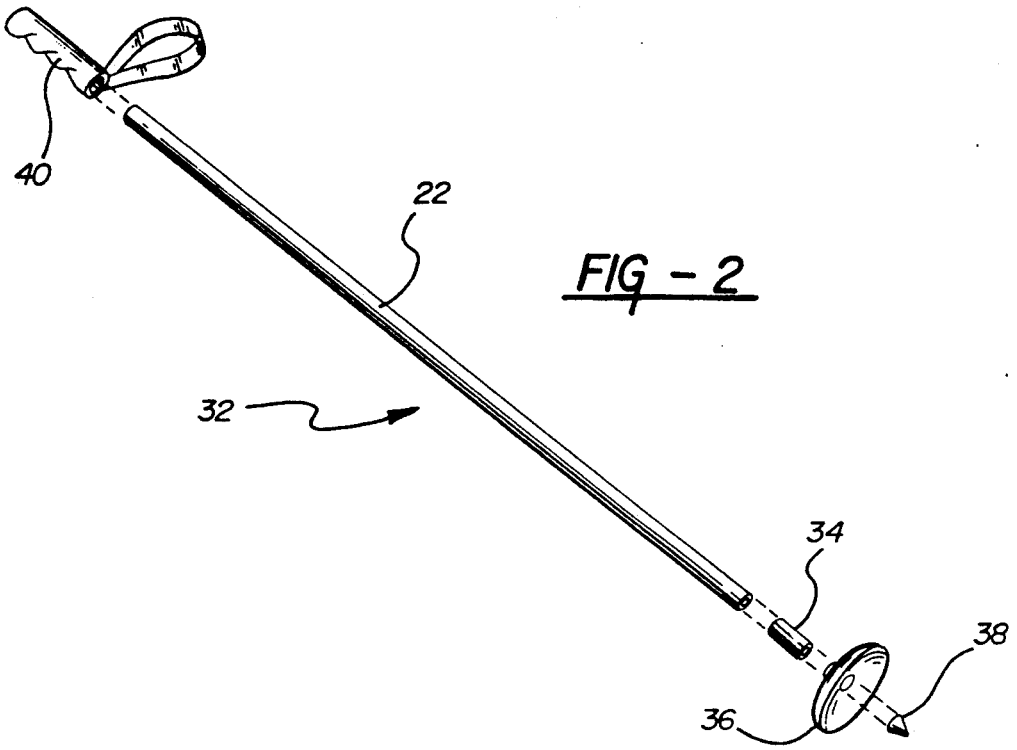
FIG - 2
FIG - 7
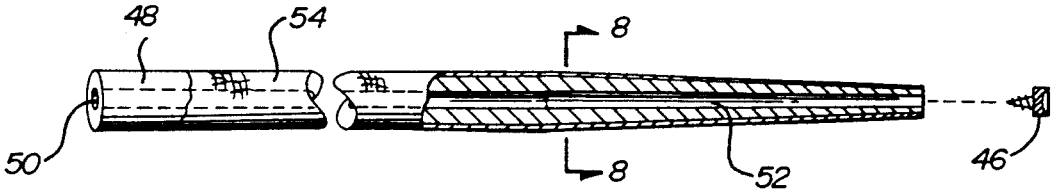
FIG - 8
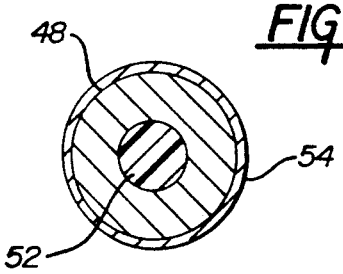
FIG - 10
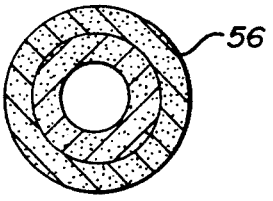
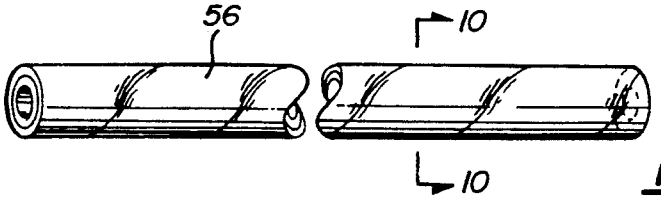
FIG - 9

COMPOSITE SKI POLE

This is a continuation of copending application Ser. No. 07/448,306 filed on Dec. 11, 1989 now abandoned.

FIELD OF THE INVENTION

The present invention relates to ski poles and in particular to ski poles having shafts comprising filament/resin composites.

BACKGROUND OF THE INVENTION

The standard state-of-the-art ski pole for the past two or three decades comprises a hollow, tapered aluminum shaft, painted with enamel and having a basket and tip mounted on one end and a hand grip mounted on the other end. Such a pole weighs about 6.5 ounces and has a tensile strength of about 50,000 psi.

The principal disadvantage of the traditional aluminum ski pole is the fact that it is relatively easily bent; i.e., the aluminum shaft is soft and tends to permanently deform or even collapse under the bending loads which are commonly encountered during skiing. A partially collapsed shaft exhibits greatly reduced bending resistance and cannot be restored to its original shape and strength. Moreover, the paint is relatively easily chipped off and the resulting exposure of bare aluminum is unsightly.

Another disadvantage of the aluminum shaft is its axial rigidity and inability to absorb shock loads. To compensate for this, one recently introduced pole includes an expensive axial shock absorber near the hand grip.

U.S. Pat. No. 4,301,201 issued in 1981 to Stout discloses a filament/resin composite ski pole comprising an annular array of continuous reinforcing filaments or fibers embedded in a synthetic resin matrix and formed into a hollow tubular shaft by the process known as pultrusion. The filaments extend rectilinearly along the length of the shaft.

SUMMARY OF THE INVENTION

According to one aspect of my invention, I provide an extraordinarily strong, flexible and shock absorbing, relatively light weight and aesthetically appealing ski pole which overcomes the performance disadvantages of prior art aluminum and composite ski poles. In general, my ski pole comprises a shaft of filaments or fibers of Kevlar (a trademark of E. I. DuPont for a polyaramid resin), carbon, glass or the like in a matrix of cured resin such as polyester, a weight of between about 3.5 and 9.3 ounces (in 48 inch length), a diameter of only about 0.5 to 0.25 inches and a tensile strength of about 140,000 psi. With this physical combination, I have been able to achieve a commercial quality ski pole which is not only aesthetically appealing and modern in appearance, but which effectively absorbs shock loads through moderate, controlled bending, and is virtually indestructible in use; i.e., even deliberate efforts to break poles which I have constructed fail due to the extraordinary tensile strength.

Moreover, I have virtually eliminated the tendency of longitudinal-fiber poles to splinter near the surface when bent by treating the surface of my pole by acrylic enamel painting or polyester veiling.

I have achieved the objectives of my invention in several different constructions, all disclosed herein. Such constructions include solid poles, hollow poles, tapered poles, non-tapered poles, filled core poles and partially-filled hollow poles as hereinafter described.

In all forms, the subject ski pole shaft is extremely strong, flexible, relatively lightweight, susceptible of mass production, and generally exhibits a more slender, streamlined appearance than prior art ski poles; i.e., it is preferably on the order of 0.25 to 0.50 inches in diameter and may be attractively finished not only with paint but also with screened-on patterns, logos and the like. The reinforcing filaments can comprise glass, carbon, or Kevlar fibers, for example, or any combination thereof, depending on the desired stiffness of the ski pole. At least some of the filaments run rectilinearly along the length of the shaft. The anti-splinter material is preferably a quick-drying acrylic enamel, but may also include a polyester veil wrapped around the filaments within the resin-matrix.

In a first embodiment of the invention, the shaft comprises a filament-reinforced resin-matrix hollow outer shaft integrally pultruded about a core member. The core member extends substantially along the entire length of the hollow outer shaft to strengthen the hollow outer shaft without adding excessive weight thereto. The core member may comprise a length of solid foam having suitable compression and weight characteristics, or alternately an extruded thermoplastic material, or almost any suitable substance such as wood or the same material which the filaments comprise. A layer of anti-splinter material surrounds the filaments to prevent filament splinters from protruding from the outer surface of the shaft. The shaft is a cylindrical, non-tapered pole approximately 0.40 inches in diameter. A basket adapter, basket, tip and grip are adhesively or frictionally attached to the shaft to make a finished ski pole.

A second embodiment of my invention comprises a solid fiber/resin shaft of about 0.5 inches nominal diameter, but tapering over the last 15 inches or so to about ⅜ inch. Fiber to resin ration is about 4:1, weight is about 9.3 ounces per 48 inch length and exhibits a tensile strength of 144,000 psi. The shaft is finished by dip coating in fast-drying acrylic enamel. The small-diameter end is drilled to accept an adhesively bonded-in tip insert. The taper can be achieved by milling.

A third embodiment is similar dimensionally to the second embodiment, but is hollow, wall thickness being about ⅛ inch. I reinforce and strengthen the tapered section by bonding in a ¼ inch diameter solid rod which may be a composite, solid resin, wood dowel or other material. This embodiment weighs only about 7.5 ounces per 48 inch length and exhibits a tensile strength of about 140,000 psi.

A fourth embodiment which is very light in weight (about 3.7 ounces per 48 inch length) and very small in diameter (about ¼ inch, comprises a hollow shaft in which the inside composite layer has longitudinally arranged fibers and the outside layer has spirally wrapped fibers at an angle of about 45°.

According to a second aspect of my invention, a method for making the ski pole shaft comprises the steps of pultruding an array of continuous reinforcing filaments through a bath of thermosetting resin, continuously feeding a core member into the filament array prior to the entrance to the resin bath, providing the filaments with a layer of anti-splinter material, further pultruding the core member, the filaments and the anti-splinter material through a thermosetting die to form a ski pole shaft and cutting the continuously pultruded ski pole shaft into suitable lengths. The ski pole shaft lengths are then fitted with a basket adapter, a basket, a tip and a grip to make a finished pole.

In a second embodiment of the method invention, the shaft comprises a filament-reinforced resin-matrix composite solid pultruded body with a layer of fast drying acrylic enamel applied after milling a taper over one end portion. The shaft is a cylindrical with a nominal diameter of approximately 0.50 inches tapering over the final 15 inches or so to about ⅜ inch. The small tip is drilled to accept a bonded-in metal tip. A hand grip and a basket are frictionally and/or adhesively attached thereto to make a finished ski pole.

BRIEF DESCRIPTION OF THE DRAWINGS

FIG. 2 is a perspective, exploded view of a finished ski pole;

FIG. 7 is a side view of still another embodiment which is tapered, hollow and partially filled;

FIG. 8 is a cross section of the FIG. 7 pole;

FIG. 9 is a side view of still another hollow, non-tapered embodiment; and

FIG. 10 is a cross section of the FIG. 9 pole.

DETAILED DESCRIPTION OF THE ILLUSTRATED EMBODIMENT

Figures 1, 3A, 3B, 4, 5, 6:
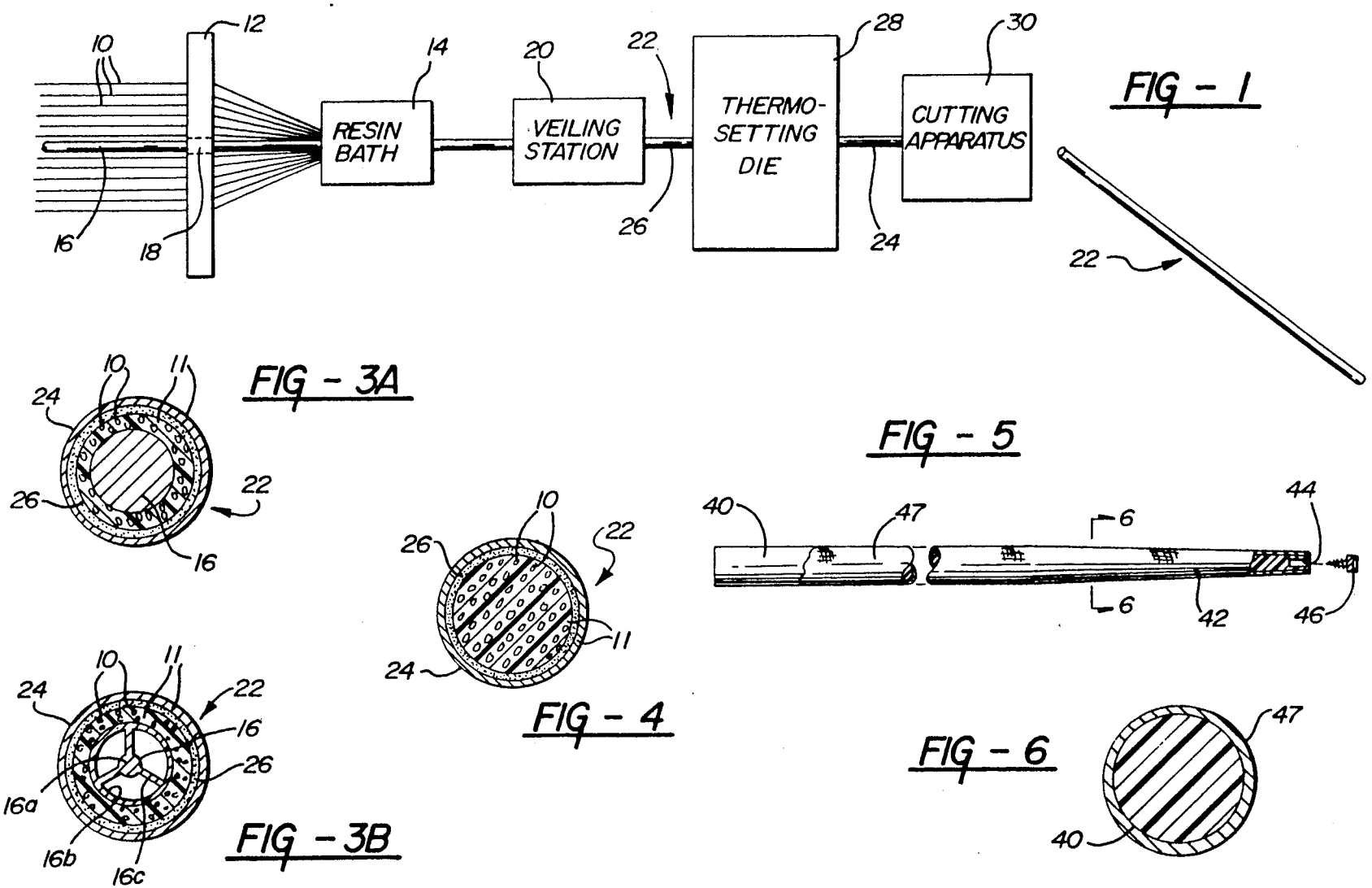
FIG. 1 is a schematic view of a method for forming a ski pole shaft according to a first embodiment of the present invention.
FIGS. 3*a*, 3*b* and 4 are cross-sectional end views of first, first alternate and second embodiments of a ski pole shaft according to the present invention.
FIG. 5 is a side view of a solid, tapered embodiment of my invention.
FIG. 6 is a cross section of the FIG. 5 pole.

Referring now to FIG. 1, the process for making a ski pole shaft according to a first embodiment of the present invention is shown in schematic form. An array of continuous reinforcing elements 10 is pultruded from a suitable filament supply (not shown). Filaments 10 may comprise glass, carbon, or Kevlar filaments, for example, or the array may comprise a combination of different filaments. The array of filaments 10 is pultruded through a suitable guide member 12, which channels the filaments into a resin bath 14 containing a thermosetting synthetic resin in liquid form.

Prior to the entrance to resin bath 14, a continuous solid foam core member 16 is extruded from a conventional extruding apparatus (not shown) through a suitable aperture 18 in guide member 12 and into the array of filaments 10, such that when core member 16 enters resin bath 14 it is intimately surrounded by filaments 10. Together filaments 10 and core member 16 are pultruded/extruded through resin bath 14, filaments 10 and core member 16 becoming thoroughly coated with the thermosettinq resin.

In an alternate embodiment, core member 16 may comprise an extruded thermoplastic core. In fact, core member 16 may comprise almost any suitable material including the same material used for filaments 10.

To prevent splinters of filaments 10 from protruding from the resin-matrix outer surface of the finished ski pole shaft 22 and creating the potential for injury to the hands of someone holding or carrying the ski pole, resin-coated filaments 10 are next provided with a thin polyester veil 26 at veiling station 20 prior to thermosetting die 28. Polyester veil 26 comprises a sheet or veil of a suitable polyester wrapped or wound around filaments 10 on core member 16. Polyester veil 26 is typically perforated to permit the liquid resin on filaments 10 and core member 16 to flow through and over the veil, covering it completely. If desired, veil 26 may first be dipped in a different thermosetting resin before being applied to filaments 10.

Core member 16 and surrounding resin-coated filaments 10 and polyester veil 26 are then further pultruded into and through a heated thermosetting die 28 to set the liquid resin and define the final cylindrical, non-tapered shape of ski pole shaft 22. The continuous ski pole shaft 22 emerging from die 28 now comprises a resin-matrix, filament-reinforced hollow outer shaft portion 24 integrally pultruded about core member 16. The outer surface of ski pole shaft 22 is smooth resin, anti-splinter polyester veil 26 being embedded completely within the resin-matrix immediately adjacent filaments 10. The continuously pultruded ski pole shaft 22 is then cut by cutting apparatus 30 into lengths suitable for use as ski poles.

Painting of ski pole shaft 22 can be eliminated by pre-coloring the thermosetting resin in resin bath 14 so that the shaft 22 coming from thermosetting die 28 already has its final color. If desired, a logo or design can be applied to the shaft 22 while it is still continuous, i.e. between thermosetting die 28 and cutting apparatus 30. A logo or design can also be applied to polyester veil 26 and the color of the thermosetting resin chosen so that the logo or design is visible through the layer of set resin covering veil 26. The non-tapered continuously-pultruded ski pole shaft 22 requires almost no additional work once it has been cut to length: the final shape and color of shaft 22 are already set; no assembly or insertion of core member 16 into ski pole shaft 22 is needed, since core member 16 has already been continuously integrally formed with ski pole shaft 22; and the smooth, resin- rich, splinter-free outer surface of ski pole shaft 22 requires no smoothing or finishing operations.

Still referring to FIG. 1, the process for making a ski pole shaft according to a second embodiment of the invention is essentially the same as the process for the first embodiment except that the step of feeding core member 16 into the array of filaments 10 prior to resin bath 14 is omitted. The array of filaments 10 is pultruded through guide member 12, which channels the filaments into resin bath 14, filaments 10 becoming thoroughly coated with the thermosetting resin. The resin-coated filaments 10 are provided with polyester veil 26 in the same manner disclosed for making the first embodiment of the invention. Resin-coated filaments 10 and polyester veil 26 are then further pultruded into and through heated thermosetting die 28 to set the liquid resin and define the final cylindrical, non-tapered shape of ski pole shaft 22. The continuous ski pole shaft 22, now emerging from die 28 comprises a resin-matrix filament-reinforced solid shaft. The outer surface of the solid shaft is smooth resin, anti-splinter polyester veil 26 being embedded completely within the resin-matrix immediately adjacent filaments 10. The continuously pultruded solid ski pole shaft 22 is then cut by cutting apparatus 30 into lengths suitable for use as ski poles and finished in the same manner as the hollow outer shaft-/core member ski pole shaft of the first embodiment of the invention.

Since there is no core member in the solid pultruded ski pole shaft of the second embodiment, the resin-matrix will be substantially continuous throughout the shaft body, interrupted only by filaments 10 and polyester veil 26. The solid ski pole shaft of this second embodiment can also typically be made thinner than the first embodiment having a core member.

While the ski pole shafts of the first and second embodiments are preferably non-tapered to eliminate additional manufacturing steps and to give them a distinctive appearance over the prior art ski poles, in some instances it may be desirable to taper the shaft. Tapering of the shaft is easily effected by introducing an intermittent tapering step, such as an intermittent tapering die or milling operation into the process shown in FIG. 1.

Referring now to FIG. 2, a finished ski pole 32 comprising ski pole shaft 22, basket adapter 34, basket 36, tip 38 and hand grip 40 is shown in an exploded view. Adapter 34 is adhesively bonded to shaft 22 near the arbitrarily chosen lower end of ski pole 22, basket 36 is next adhesively or frictionally mounted on adapter 34, and tip 38 is adhesively bonded to the lower end of shaft 22. Hand grip 40 can be adhesively or frictionally mounted on the opposite or upper end of shaft 22 to complete ski pole 22.

Referring to FIGS. 3*a*, 3*b* and 4, the core structures of the first, first alternate and second embodiments of ski pole shaft 22 can be seen in cross-section.

In FIG. 3*a*, hollow outer shaft 24 comprising reinforcing filaments 10 embedded in resin-matrix 11 has been integrally pultruded about core member 16, such that no separate assembly or bonding step is required to engage and maintain the two elements in a tight integral fit. Core member 16 comprises solid molded or extruded foam extending longitudinally along the entire length of hollow outer shaft 24. The lightweight, integrally pultruded foam core member 16 resiliently strengthens composite hollow outer shaft 24 enough to provide adequate support for a skier, and to resist crushing of the ski pole shaft, without making the ski pole excessively heavy.

In FIG. 3*b*, hollow outer shaft 24 comprising reinforcing filaments 10 embedded in a resin matrix 11 has been integrally pultruded about a thermoplastic core member, such that no separate assembly or bonding step is required to engage and maintain the two elements in a tight, integral fit. The thermoplastic core member comprises a longitudinal center rib 16*a* coaxial with and extending longitudinally along the entire length of hollow outer shaft 24, an annular outer wall portion 16*b* corresponding substantially to the inside diameter of hollow outer shaft 24, and a plurality of radially extending ribs 16*c* joining longitudinal rib 16*a* and annular wall 16*b*. The thermoplastic core member strengthens shaft 22 in the same lightweight, flexible manner as foam core member 16 in FIG. 3*a*.

In FIG. 4, solid pultruded ski pole shaft 22 comprises an array of reinforcing filaments 10 embedded in resin matrix 11.

In all of the illustrated embodiments of FIGS. 3*a*, 3*b* and 4, ski pole shaft 22 is extremely tolerant of bending loads, i.e. even after severe bending ski pole shaft 22 simply returns to its normal straight orientation as soon as the bending load is removed. During severe bending, however, it is not uncommon for some of reinforcing elements 10 to break. While this breakage does not noticeably affect the overall performance of ski pole shaft 22, fine splinters of filaments 10 can protrude from the resin-matrix outer surface of shaft 22, creating a splinter hazard to the hands of the person using the pole. To prevent this, polyester veil 26 is wrapped or wound around filaments 10 in all of the illustrated embodiments to keep the outer surface of ski pole shaft 22 smooth, resin-rich and free of filament splinters which might otherwise protrude.

FIGS. 5 and 6 illustrate a further embodiment of the invention in the form of a filament/resin ski pole shaft 40 which is manufactured in solid form, approximately 79% filament by weight and 21% resin by weight for a filament to resin ratio of approximately 4:1. The nominal diameter of pole shaft 40 is ½ inch but the distal portion 42 is milled after manufacture to produce a uniform taper over a length of approximately 15 inches to a diameter of approximately ⅜ inch. The tapered end is drilled out to produce a cavity 44 of about ¾ of an inch in length to receive a cadmium plated hardened steel tip 46. The tip has a slightly hollowed end surface and is bonded in place with an epoxy adhesive.

Shaft 40 weighs approximately 9.3 ounces per 48 inch length and exhibits a tensile strength of approximately 144,000 psi. As such it is virtually indestructible in ordinary use; i.e., it will withstand extreme bending loads without fracture and will, after the loads are removed, return to its original straight configuration. Bending under such loads is totally elastic and appears to produce no deleterious effects whatsoever. Moreover, in this diameter and strength combination, pole 40 exhibits enough resilience to comfortably absorb shock loads which are incurred in normal and even fast pace competitive skiing thereby eliminating the need for a special axial shock absorber as hereinbefore mentioned. After milling but before the installation of the hardened steel tip 46 and the other normal accessories; i.e., basket and handgrip, pole 40 is dip-coated in a fast drying acrylic paint such as that which is currently available from the Sherwin Williams Co. It is especially convenient to match the resin color to the paint color so that even damage to the pole surface which is severe enough to remove some paint produces no unsightly exposure of underlying material such as is often the case with painted aluminum poles. The acrylic paint is sufficiently flexible to withstand the flexing and bending of the pole shaft 40 without shipping, breaking or fracturing at the surface. Moreover, the paint acts as a veil to prevent the exposure of fractured filament ends.

FIGS. 7 and 8 illustrates a still further embodiment which is in the form of a ski pole shaft 48 which is essentially dimensionally similar to the pole shaft 40 of FIG. 5; i.e., nominal diameter is ½ inch and the pole is milled after forming over the distal 15 or so inches to produce a taper to a final or end diameter of approximately ⅜ of an inch. However, pole 48 is formed with a continuous interior hollow 50 thereby to exhibit a wall thickness of approximately ⅛ inch. In this configuration I have found that the tapered end, because of the reduced wall thickness, is subject to crushing under lateral compression load and to compensate for this tendency I adhesively bond into the hollow, a ¼ inch diameter solid reinforcing filler rod 52. Thereafter I bond in the tip 46 which is identical to that utilized in the embodiment of FIG. 5. Finally, I dip-coat the pole 48 in fast-drying acrylic enamel to produce an aesthetically pleasing and protective paint surface 54. The paint surfaces of both poles 40 and 48 are capable of receiving screened-on patterns such as graphics, logos, personalizations and the like. Basket and handgrip are thereafter adhesively/frictionally applied in the fashion previously described.

The pole shaft 48 in a 48 inch length weighs approximately 7.5 ounces and, because of the hollow interior, is lighter than the pole shaft 40 of FIG. 5. However, I have been able to achieve tensile strengths of 140,000 psi or better with fiber-to-resin ratios of approximately 4:1; 79% by weight fiber and 21% by weight resin. Accordingly, even though the pole shaft 48 is significantly lighter than the pole shaft 40, there is no significant reduction in tensile strength and the consequential ability of the pole shaft to withstand extreme bending loads. Again, I have found that in normal use the pole shaft 48 is virtually indestructible. The reinforcing rod may be wood, but is preferably a polymeric material and is adhesively bonded in place.

Finally, an extremely lightweight pole shaft 56 suitable for use in fabricating lightweight, high performance ski poles is illustrated in FIGS. 9 and 10. Pole shaft 56 is of uniform diameter over its length; i.e. it is not tapered and may be manufactured in diameters on the order of ¼ to 38 of an inch. Accordingly, the pole shaft 56 produces a ski pole which is very modern and contemporary in appearance, yet, manufactured as hereinafter described, is essentially as capable of withstanding bending loads as the pole shafts 40 and 48 of FIGS. 5 and 7, respectively.

Pole shaft 56 is manufactured in two layers, the first layer comprising a 79% longitudinal filament and 21% polyester resin combination wherein the filaments are protruded and longitudinally arranged as is the case with all previously described embodiments. However, a spirally wrapped outer layer with a bias angle of approximately 45 is also provided. The interior of pole shaft 56 is hollow; wall thickness on the order of ⅛ of an inch. Weight for a 48 inch length is approximately 3.7 ounces. The shaft 56 is preferably manufactured utilizing carbon fibers commonly known as "graphite" and is also dip painted as hereinbefore described.

It is to be understood that the foregoing illustrated embodiment is a description of a preferred embodiment in accordance with 35 U.S.C. 112, and is not intended to be limiting. For example, the method for making the filament/resin composite outer. shaft, non-composite inner core ski pole shaft of the first embodiment of the present invention is not limited to the process known as pultrusion, but may comprise any suitable method of continuously integrally forming a filament/resin composite outer shaft about a core member and still lie within the scope of the invention. The core member may comprise materials other than solid foam or extruded thermoplastic, and may be of any almost suitable form which provides sufficient strength to the hollow outer shaft and allows it to bend without breaking. The reinforcing filaments or fibers in both embodiments of the shaft are not limited to glass, carbon, or Kevlar filaments, but may comprise other suitable materials. The basket adapter, basket, tip and grip may take any suitable form and may be fastened to the shaft in any number of ways. Also, polyester veil 26 may comprise other suitable veiling materials and may be applied to filaments 10 before or after resin bath 14.

I claim:

1. A high-tensile strength, lightweight ski pole comprising:
   a shaft;
   a basket mounted adjacent a first lower end of said shaft;
   a tip mounted on said first lower end of said shaft; and
   said shaft comprising a filament-reinforced, resin-matrix composite body having a polymeric coating on the outer surface thereof; wherein said outer surface coating comprises a sheath of a polymeric material covering said reinforcing filament and embedded in said resin-matrix.

2. A ski pole as defined in claim 1, wherein said first lower end is tapered and has a variable wall thickness and said shaft has an axial bore of constant diameter.

3. A ski pole as defined in claim 2, wherein said filler rod mates with the hollow bore along the tapered first lower end to increase the wall thickness of the tapered first lower end.

4. A ski pole as defined in claim 3, wherein the filler rod is hollow.

5. A ski pole as defined in claim 3, wherein the filler rod is solid.

6. A ski pole as defined in claim 3, wherein the filler rod is of constant diameter.

7. A high-tensile strength, lightweight ski pole comprising:
   a shaft;
   a tip mounted on a first lower end of said shaft; and
   a grip mounted on the opposite end of said shaft;
   said shaft comprising a filament reinforced, resin-matrix composite body having a filament-free layer comprising a polymeric coating over the outer surface of said resin-matrix composite body, wherein the outer surface coating comprises polyester layer wrapped about the reinforcing filaments and embedded in the resin matrix.

8. A ski pole shaft comprising a filament-reinforced, resin-matrix composite body, the shaft having an axial bore over substantially the entire length thereof, the shaft tapered over a minor portion of its length at a first lower end, the tapered first lower end having a variable wall thickness and the axial bore at the first lower end having a substantially constant diameter; wherein,
   the ski pole shaft further includes filler means disposed within the axial bore in the tapered first lower end to mate with the axial bore along the tapered first lower end to increase the wall thickness of the tapered first lower end.

9. A ski pole shaft as defined in claim 8, wherein the axial bore is cylindrical and the filler means comprise a filler rod.

10. A ski pole shaft as defined in claim 9, wherein the filler rod is hollow.

11. A ski pole shaft as defined in claim 9, wherein the filler rod is solid.

12. A ski pole shaft as defined in claim 8, wherein the filler means comprise the same material as the composite body of the ski pole shaft.

13. A ski pole shaft as defined in claim 8, wherein the shaft has a maximum diameter over its principle length of less than ½ inch and a tensile strength on the order of 140,000 psi.

* * * * *

UNITED STATES PATENT AND TRADEMARK OFFICE

CERTIFICATE OF CORRECTION

PATENT NO. : 5,294,151

DATED : March 15, 1994

INVENTOR(S) : Goode

It is certified that error appears in the above-indentified patent and that said Letters Patent is hereby corrected as shown below:

Column 3, line 56, delete "thermosettinq" and insert --thermosetting--;

Column 6, line 43, delete "shipping" and insert --chipping--;

Column 7, line 21, delete "38" and insert --3/8--;

Column 7, line 44, delete "outer.shaft" and insert --outer shaft--.

Signed and Sealed this

Ninth Day of August, 1994

*Attest:*

*Attesting Officer*

Bruce Lehman

BRUCE LEHMAN

*Commissioner of Patents and Trademarks*